US006364135B1

(12) United States Patent
Sirois et al.

(10) Patent No.: US 6,364,135 B1
(45) Date of Patent: Apr. 2, 2002

(54) GUN BARREL HOLDER AND SUPPORT BASE

(75) Inventors: Michael A. Sirois, Dover; James W. Geekie, Newmarket, both of NH (US)

(73) Assignee: On Target Technologies, Dover, NH (US)

( * ) Notice: Subject to any disclaimer, the term of this patent is extended or adjusted under 35 U.S.C. 154(b) by 0 days.

(21) Appl. No.: 09/705,081

(22) Filed: Nov. 2, 2000

(51) Int. Cl.[7] ..... A47F 5/00; A47F 7/00
(52) U.S. Cl. ..... 211/64; 211/60.1
(58) Field of Search ..... 211/64, 70.6, 60.1; 42/94, 95; 224/913; D6/552

(56) References Cited

U.S. PATENT DOCUMENTS

| | | | | | |
|---|---|---|---|---|---|
| 945,520 | A | | 1/1910 | Greenwood | |
| 3,491,893 | A | * | 1/1970 | Morris | |
| 3,964,613 | A | | 6/1976 | Anderson, Jr. | |
| 4,226,399 | A | | 10/1980 | Henderson | |
| 4,410,095 | A | * | 10/1983 | Dembicks | 211/70.6 |
| 4,807,381 | A | | 2/1989 | Southard | |
| 4,873,777 | A | | 10/1989 | Southard | |
| 4,941,577 | A | * | 7/1990 | Ferree et al. | 211/70.6 |
| 4,949,559 | A | | 8/1990 | Glines | |
| 4,971,208 | A | | 11/1990 | Reinfried, Jr. et al. | |
| 5,050,331 | A | | 9/1991 | Burkhalter | |
| 5,058,302 | A | | 10/1991 | Minneman | |
| D346,003 | S | | 4/1994 | Anderson | |
| D359,392 | S | | 6/1995 | Bellington | |
| 5,600,913 | A | | 2/1997 | Minneman | |
| 5,669,515 | A | * | 9/1997 | Tisbo et al. | 211/70.6 |
| 5,682,700 | A | | 11/1997 | Sandberg | |
| D426,612 | S | | 6/2000 | Primeau, IV | |

* cited by examiner

*Primary Examiner*—Robert W Gibson, Jr.
(74) *Attorney, Agent, or Firm*—Kevin M. Farrell

(57) ABSTRACT

The present invention is a receiver for supporting the lug end of a detachable barrel of a gun in a position that reduces the likelihood of the barrel being damaged during storage. The receiver is designed to be installed in a gun cabinet or gun safe and support a barrel by the pins at the lug end. The barrel is maintained in a vertical position above the floor of the gun cabinet or safe. By storing the barrel in a secured vertical position it is less likely that the barrel will be jarred thus knocking a gun sight out of alignment. In addition, by suspending the barrel above the floor of the gun cabinet or safe, a heavy object can not fall on the barrel causing damage. The receiver is a blank manufactured out of metal, wood, plastic, or ceramic that has a slot that provides non-friction support for the detachable barrel of a gun. The slot can either be open or, in an alternate embodiment, closed thus forming an aperture. The invention provides a male and female end such that multiple holders can be attached in series. An alternate configuration of the present invention provides a solid base, through the use of a support arm, to support the barrel of a gun. This stable base allows the user of the gun to apply torque to the barrel while performing routine maintenance.

10 Claims, 3 Drawing Sheets

GUN BARREL HOLDER AND SUPPORT BASE

BACKGROUND OF THE INVENTION

Thompson/Center Arms, Inc. manufactures a line of rifles and hand guns that permits the user to interchange the barrels on a single gun stock. This ability to interchange barrels allows a hunter to maintain one gun stock while providing the flexibility to use different caliber ammunition depending on the game being hunted. For a target shooter, this interchangeability allows the shooter to interchange barrels of varying lengths and calibers depending on the targets being shot and the shooter's individual preferences. This flexibility to interchange barrels has the advantages described above, but also presents a number of disadvantages to the owner of the weapon.

The conventional method of storing a barrel that is separated from a gun is to place the barrel into a gun 'sock'. A gun sock consists of a tube of soft material, such as cotton or nylon, that protects the outer surface of the gun barrel from being marred. The sock, with the barrel enclosed, is typically placed in a corner of a gun cabinet or safe. Storage of the barrel in a gun sock protects the surface of the barrel, but it subjects the barrel to other potential damage. In one instance, the gun sight on the barrel can be knocked out of alignment by being jarred by other barrels being placed in a corner of the gun cabinet or safe. This requires the user of the gun to check and realign the sight every time the barrel is removed from storage. Realigning the sight is a tedious process. However, if the gun sight is not properly aligned, a hunter could discharge the weapon with the resulting shot missing the target. This misaligned shot also has the potential of damaging private property or hitting a bystander. If the sight is misaligned, a target shooter will have poor target scores.

Additionally, a gun barrel leaning against the corner of a gun cabinet or safe may fall or get hit by a falling weight. This has the potential of causing damage to the gun barrel. Gun manufacturers warn gun users that a barrel that has been struck must be inspected prior to use to assure that there is no damage or obstruction to the gun barrel. Failure to perform this inspection can result in injury to the shooter or a bystander.

In addition to storing the separated barrels, there are limited means available to support a gun barrel that has been removed from the gun when the user performs routine maintenance. The most common means available consists of securing the gun barrel with a vise. This method of securing the barrel can result in marring to the surface of the gun, and does not provide the most effective support possible.

For the reasons discussed above, a holder that supports a gun barrel in a gun cabinet or safe, that minimizes the risk that the gun will be damaged or, that the sight will be knocked out of alignment, and could also be used for holding the barrel for routine maintenance and cleaning, would be a major advantage.

SUMMARY OF THE INVENTION

The present invention relates to an apparatus for holding the detachable barrel of a gun in a position that reduces the likelihood of the barrel being damaged during storage. The present invention is designed to be installed in a gun cabinet or gun safe and support a barrel by the pins at the lug end. The barrel is maintained in a vertical position above the floor of the gun cabinet or safe. By storing the barrel in a secured vertical position it is less likely that the barrel will be jarred thus knocking the sight out of alignment. In addition, by suspending the barrel above the floor of the gun cabinet or safe, a heavy object can not fall on the barrel causing damage.

An alternate configuration of the present invention provides a solid base to support the barrel of a gun. This stable base allows the user of the gun to apply torque to the barrel while performing routine maintenance.

DESCRIPTION OF PREFERRED EMBODIMENTS

The present invention relates to an apparatus that provides support for a gun barrel when stored in a gun cabinet or safe. The apparatus provides a simple means for protecting an investment in expensive gun barrels by allowing the barrel to be vertically supported in a gun cabinet or safe. The apparatus also allows a gun user to store barrels in a safe or cabinet fully exposed therefore not requiring the user to remove large optical gun sights.

In addition, an alternate embodiment of the present device provides a stable working support for a gun barrel. The apparatus provides a support that securely holds a gun barrel. Unlike a vise which applies large amounts of pressure to the side of a barrel, potentially marring or deforming the barrel, the present invention is manufactured with varying dimensions thereby securely holding a variety of different barrels.

Figure 1:
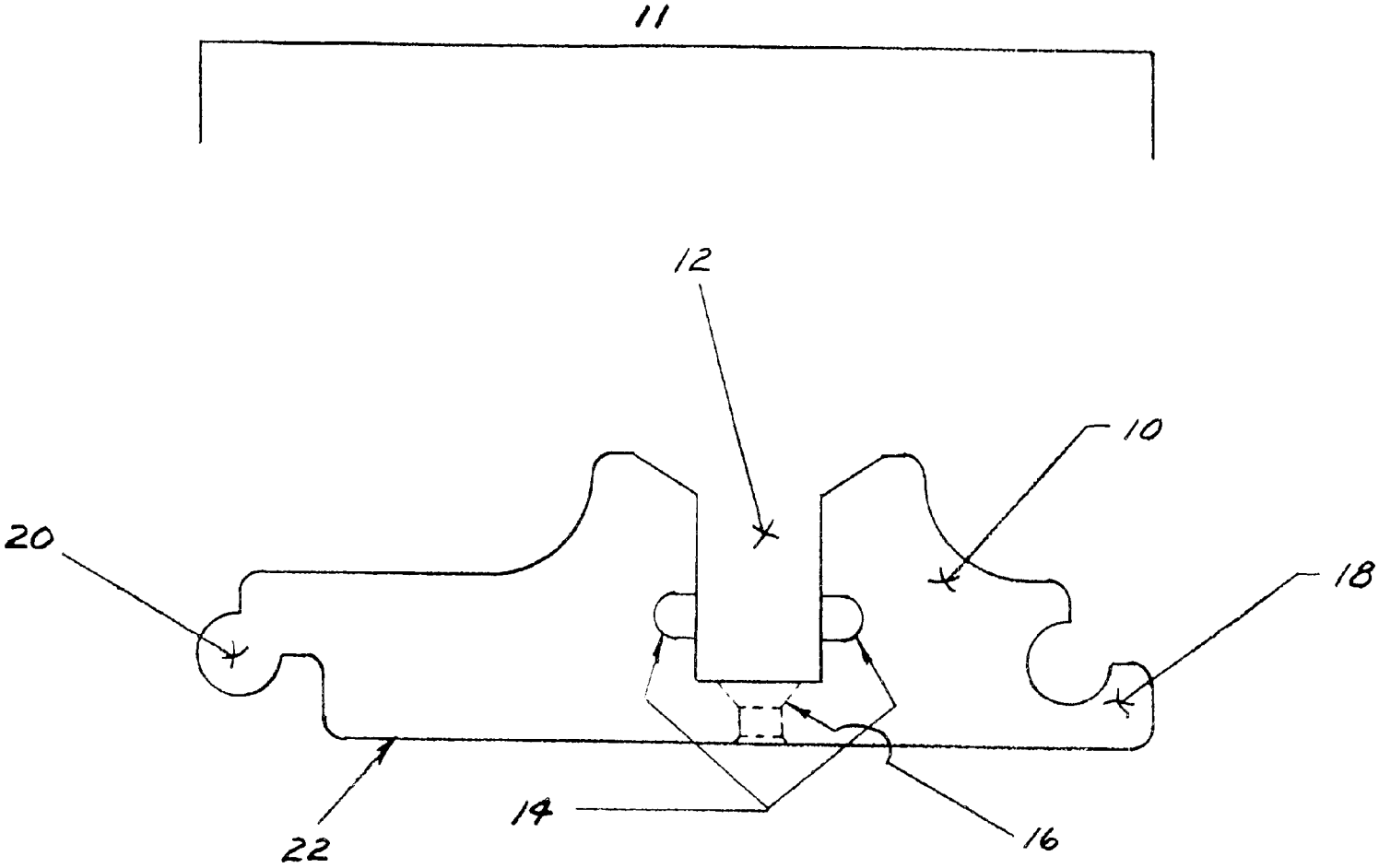
FIG. 1 is a side view of the holder.
Figure 2:
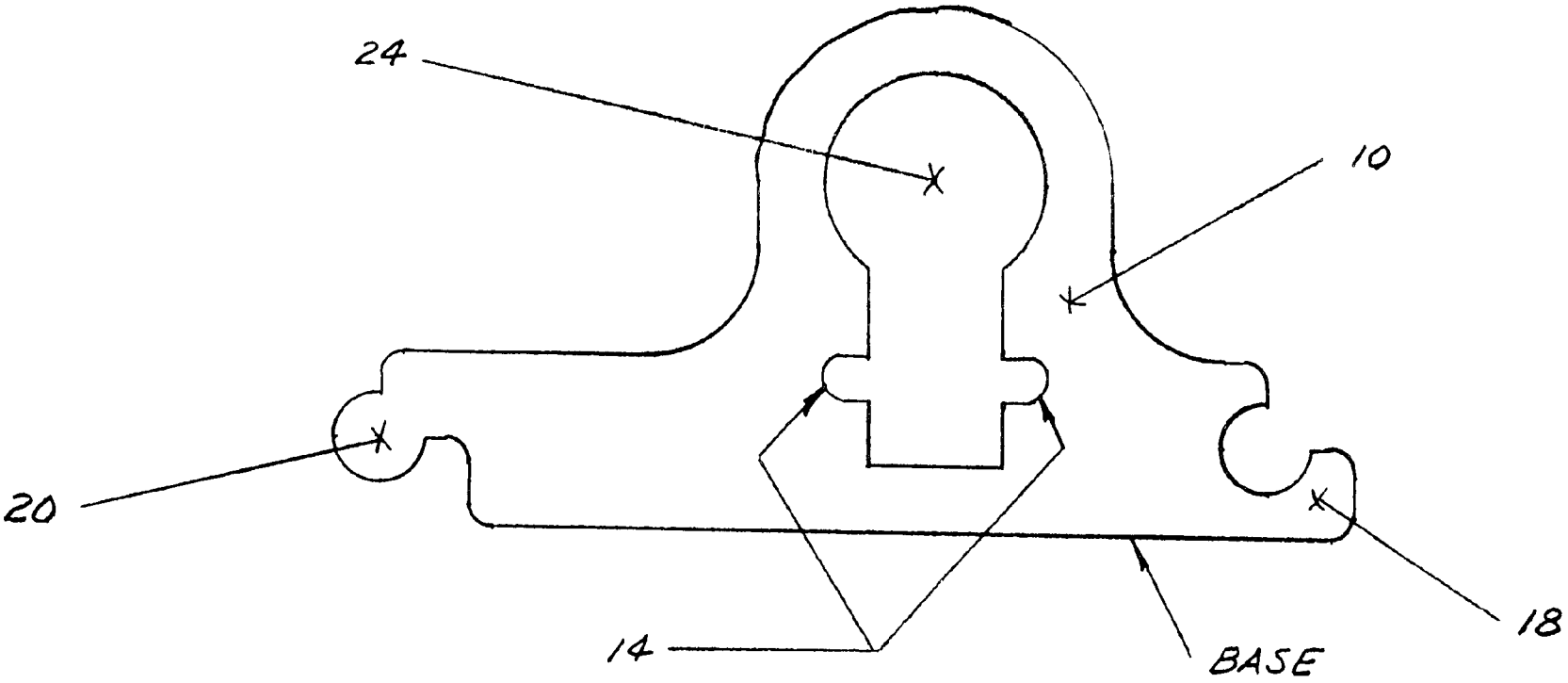
FIG. 2 shows an alternate embodiment to the present invention where the support for the barrel is circumferential.

Referring to FIGS. 1 and 2, the preferred embodiment of the holder 11 is shown in FIG. 1. A blank 10 is manufactured out of any workable material. Depending on the method of manufacture, the preferred material is 6061 aluminum if the holder is to be machined, and 380 alloy if the holder is to be cast. While aluminum is the preferred material, other materials such as other workable metals, plastic, composite materials or ceramics can also be used. A slot 12 is provided in the blank 10. The slot 12 should be wide enough to accommodate the lug end of the gun barrel without scratching or marring any surface, but should not be too wide as to allow the barrel to become loose and fall. In the preferred embodiment, the slot 12 should have a width of approximately 0.505 inches to support a Thompson/Center Arms, Inc., Contender® barrel, and should have a width of approximately 0.625 inches to support a Thompson/Center Arms, Inc., Encore® barrel. Also, the slot 12 should have a depth of approximately 0.56 to 0.85 inches. Additionally, a pair of holding slots 14 in contact with the slot 12 are provided to secure the pins of the lug end (i.e., the end of the barrel which engages the gun stock) of the barrel. In the preferred embodiment, the holding slots 14 are machined to a depth of approximately 0.156 inches into the blank 10, however one skilled in the art will recognize that the machined depth of the holding slots 14 can be varied through a wide range without adversely affecting the utility of the holder. Additionally, the holding slots 14 will have a width of approximately 0.187 inches. The holding slots 14 will have a length of approximately 0.4 inches measured from the center of the slot 12. However, one skilled in the arts will recognize that the holding slots 14 can be longer and remain functional. An attachment hole 16 is provided in the base 22 of the blank 10 to allow the holder 11 to be attached to a wall in a gun cabinet or gun safe. The attachment hole 16 should be of sufficient diameter to allow for a screw to attach the holder 11 to a surface in a gun cabinet or safe. In the preferred embodiment there is a male end 20 and a female end 18 at opposed ends of the blank to allow the holders 11 to be attached in series.

FIG. 2 shows an alternate embodiment to the invention where the slot 12 is replaced by an aperture 24. The aperture 24 completely surrounds the barrel of the gun, providing additional support. In the preferred embodiment, the aperture has an inside diameter of approximately 1.03 inches.

Figure 3:
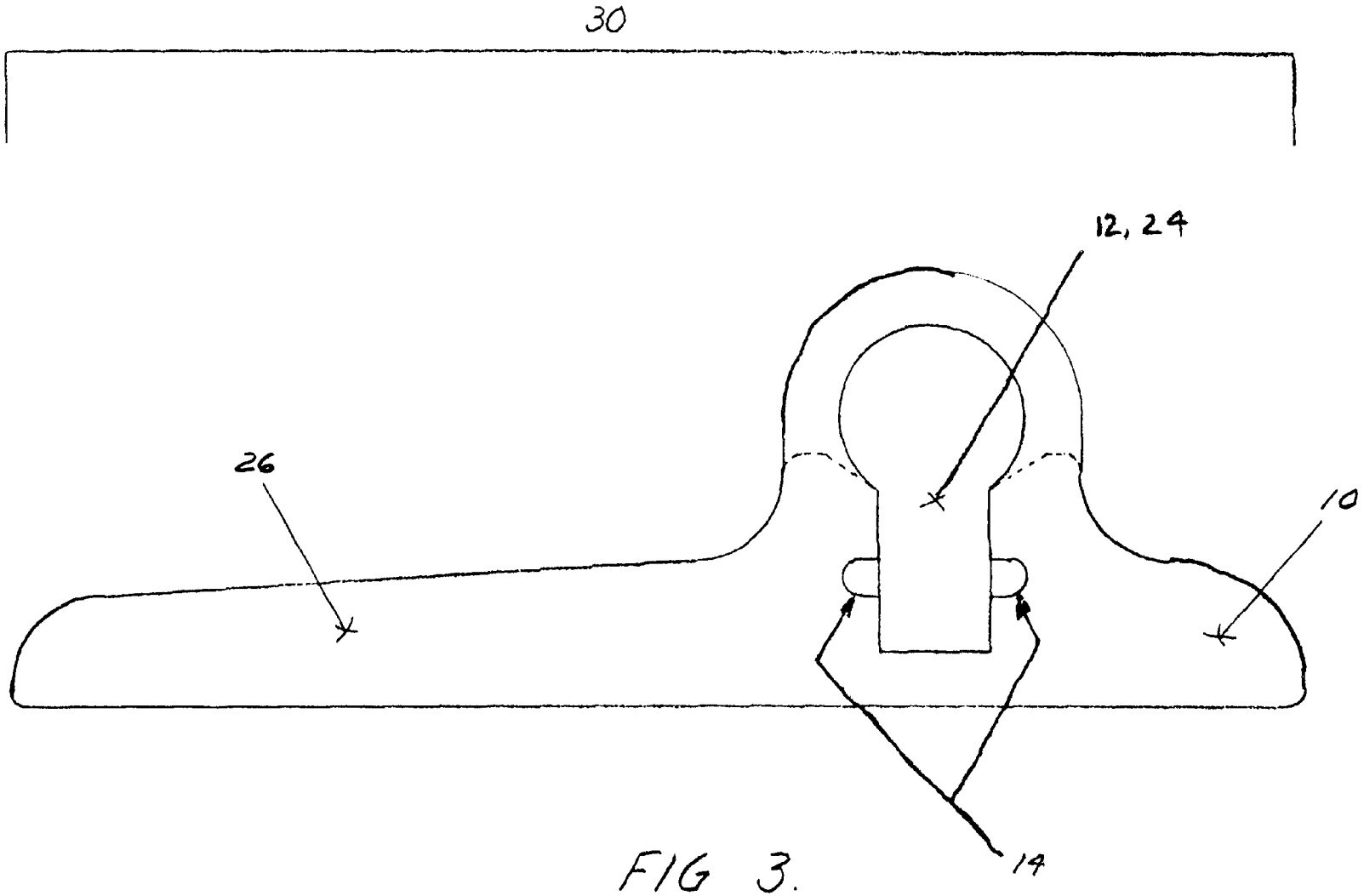
FIG. 3 shows two alternate embodiments that include a support arm for providing stability to the receiver for performing maintenance on a barrel.

FIG. 3 shows a support stand 30 embodiment for supporting the barrel while maintenance is being performed. The support stand 30 is comprised of a blank 10 manufactured out of metal, such as aluminum, or any other workable material with holding slots 14. The support stand 30 is similar to the holder 11 as shown in FIGS. 1 and 2 except that in the preferred embodiment, the support stand 30 has a support arm 26 but no female and male ends for attachment in series. The support arm 26 provides additional stability for the support stand 30 when torque is applied to a gun barrel when maintenance is performed. In the preferred embodiment, the support arm 26 has a length of approximately 2 inches, though one skilled in the arts will recognize that a holder 11 with a longer or shorter arm could be manufactured. It will also be readily apparent to one skilled in the art that while the preferred embodiment of the support stand 30 has a single support arm 26, the blank could be manufactured with additional support arms. It will also be readily apparent that the support stand 30 can be manufactured with either a slot 12, or an aperture 24.

What is claimed is:

1. A receiver for holding a gun barrel when separated from a gun stock, said gun barrel having lug end pins for engaging the gun stock, said receiver comprising;

a) a blank having a slot, said slot providing a non-friction fit for the lug end of the gun barrel; and b) a plurality of pin slots, said pin slots disposed along the perimeter of the slot such that the lug end pins of the gun barrel engage the pin slots thereby securely holding the gun barrel and preventing rotational movement.

2. The receiver of claim 1 wherein the pin slots are shouldered such that in use, the removable gun barrel is advanced into the receiver to the point at which the lug end pins encounter the shoulder in the pin slots thus allowing storage of the gun barrel in a vertical orientation.

3. The receiver of claim 1 further comprising a male and a female end provided on opposed sides of the receiver such that the male end of one receiver is compatible with the female end of another receiver.

4. The receiver of claim 1 where at least one attachment hole is provided in the blank to allow fastening the blank to a surface.

5. The receiver of claim 1 where the blank is constructed from a material selected from the group comprising metal, ceramic, composite materials, and hard plastic.

6. The receiver of claim 1 where the blank has at least one leg extending in a direction perpendicular to the gun barrel, such that torque can be applied to the gun barrel.

7. The receiver of claim 1 where the slot is dimensioned to accommodates, with minimal clearance, a lug end having a width of approximately 0.505 inches.

8. The receiver of claim 1 where the slot is dimensioned to accommodates, with minimal clearance, a lug end having a width of approximately 0.625 inches.

9. The receiver of claim 1 where the slot has a width of between 0.50 inches and 0.65 inches and a depth of 0.562 inches to 0.847 inches.

10. The receiver of claim 1 where the slot provides non-frictional circumferential support to the lug end of a gun barrel.

* * * * *